US006769711B1

(12) United States Patent
Martin et al.

(10) Patent No.: US 6,769,711 B1
(45) Date of Patent: Aug. 3, 2004

(54) GAS POWERED BACKWARDS RELEASE SKI BINDING

(75) Inventors: Ralph M. Martin, 340 Cottonwood Ct., Longmont, CO (US) 80501; Terry E. O'Connell, 15527 Huron St., Broomfield, CO (US) 80020

(73) Assignees: Ralph M. Martin, Longmont, CO (US); Terry E. O'Connell, Broomfield, CO (US)

( * ) Notice: Subject to any disclaimer, the term of this patent is extended or adjusted under 35 U.S.C. 154(b) by 0 days.

(21) Appl. No.: 09/748,970

(22) Filed: Dec. 27, 2000

Related U.S. Application Data

(60) Provisional application No. 60/224,312, filed on Aug. 10, 2000.

(51) Int. Cl.[7] ..... A63C 9/088

(52) U.S. Cl. ..... 280/625; 280/634

(58) Field of Search ..... 280/612, 613, 280/620, 623, 625, 634, 819, 11.213, 14.21, 14.23, 604, 605

(56) References Cited

U.S. PATENT DOCUMENTS

| | | | | |
|---|---|---|---|---|
| 2,616,714 A | | 11/1952 | Cubberley | |
| 3,528,672 A | * | 9/1970 | Wunder | 280/612 |
| 3,612,559 A | | 10/1971 | Petersen et al. | |
| 3,794,339 A | * | 2/1974 | Smolka | 280/612 |
| 3,820,803 A | | 6/1974 | Frisch et al. | 280/11.35 |
| 3,866,929 A | | 2/1975 | Lacroix | |
| 3,870,326 A | | 3/1975 | Cubberley | |
| 3,888,498 A | * | 6/1975 | Gertech et al. | 280/634 |
| 3,961,802 A | | 6/1976 | Vannatter | |
| 3,976,308 A | | 8/1976 | Näpflin | |
| 4,003,587 A | | 1/1977 | Salomon | |
| 4,129,245 A | | 12/1978 | Bonvallet | |
| 4,135,735 A | | 1/1979 | Beyl | |
| 4,319,767 A | * | 3/1982 | Emilson | 280/634 |
| 4,324,409 A | | 4/1982 | Larsen et al. | |

(List continued on next page.)

FOREIGN PATENT DOCUMENTS

| | | | | |
|---|---|---|---|---|
| AU | 304 329 | | 12/1972 | A63C/9/08 |
| CH | 467 081 | | 1/1969 | A63C/9/00 |
| DE | 467 081 | | 1/1969 | A63C/9/00 |
| DE | 304 329 | | 12/1972 | A63C/9/08 |
| DE | 2402684 | * | 7/1975 | 280/612 |
| DE | 2406015 | * | 8/1975 | 280/612 |
| DE | 2408965 | | 9/1975 | A63C/9/08 |
| DE | 2721691 | | 12/1977 | A63C/9/08 |
| EP | 336782 | | 10/1989 | A63C/11/00 |

OTHER PUBLICATIONS

PCT Search Report—Date of Mailing Nov. 21, 2001.
web site: www.aspenhistory.com/tipchp3.html; date: Jan. 20, 2003; title: Tip to Tale—Bindings; author: unknown (printed copy in file).

*Primary Examiner*—Frank Vanaman
(74) *Attorney, Agent, or Firm*—Patent Law Offices of Rick Martin, P.C.

(57) ABSTRACT

Downhill ski bindings are mounted with the toe and/or heel piece mounted to a moveable track. For a quick release even backward, a ski pole handle button is depressed. A signal reaches a receiver on the ski. The receiver activates an actuator which pulls the track, thereby enlarging a mounting distance for the boot. The boot is released since the binding system is instantly sized too big for the boot. Gas and spring release mechanisms are disclosed.

21 Claims, 13 Drawing Sheets

U.S. PATENT DOCUMENTS 4,376,545 A * 3/1983 Sandorf ..... 280/605
4,415,176 A 11/1983 Hull
4,418,937 A 12/1983 Salomon
4,512,594 A 4/1985 Eyre
4,545,598 A * 10/1985 Spitaler et al. ..... 280/612
4,572,541 A 2/1986 Bernard et al.
4,835,523 A 5/1989 Pruett
5,004,065 A * 4/1991 Goud ..... 280/605
5,150,913 A 9/1992 Hoelzl
5,158,317 A * 10/1992 Sedlmair et al. ..... 280/605
5,188,387 A 2/1993 Ruffinengo
5,308,102 A 5/1994 Bildner
5,328,201 A 7/1994 Wladar
5,362,087 A 11/1994 Agid
5,498,017 A * 3/1996 Rohrmoser ..... 280/612
5,501,483 A 3/1996 Stepanek et al.
5,730,457 A * 3/1998 Couderc et al. ..... 280/602
5,743,550 A 4/1998 Frohwein
5,813,690 A 9/1998 Dogat ..... 280/634
6,007,086 A * 12/1999 Hopkins ..... 280/612
6,196,570 B1 3/2001 Klubitschko
6,206,404 B1 3/2001 Buquet et al.

* cited by examiner

VO
VC
OPEN
CLOSED
CG
349"S"

GAS POWERED BACKWARDS RELEASE SKI BINDING

CROSS-REFERENCE TO RELATED APPLICATION

The present application is a non-provisional claiming priority to provisional U.S. application No. 60/224,312 filed Aug. 10,2000.

FIELD OF THE INVENTION

The present invention relates to ski bindings that automatically release when a skier triggers a remote transmitter by pushing a button on the ski pole, bindings, or other suitable location.

BACKGROUND OF THE INVENTION

It is estimated that over 10,000 crippling knee injuries occur each ski season in Colorado, U.S.A., alone. Extrapolating worldwide there might be over 50,000 knee injuries each ski season worldwide. Great advances have been made in downhill ski bindings to automatically release during violent forward falls. However, several problems still exist with the best downhill ski bindings.

A serious problem is the slow, twisting backward fall. Most anterior cruciate ligament (ACL) injuries occur with this type of fall. Expert skiers teaching children fall during a lesson and tear their ACL. A damaged ACL can be treated with a modern, complex, and expensive surgery called a patella tendon graft replacement for the ACL. Other body parts such as the hamstring tendon can also be used to replace the damaged ACL.

Thus, two surgeries are required. First a body part such as the patella tendon is harvested. Second the damaged ACL is removed and replaced with the harvested body part.

A good result requires six months for the replacement ACL to gain strength and function like the original ACL. About a year's physical therapy is required to regain maximum use of the leg. Two wounds must heel, without infection. Stiffness related to scar tissue in the knee joint sometimes leads to loss of full range of motion. Atrophy of the leg muscles from the downtime of surgery adds stress to the already weakened knee. Additional ACL and related injuries can occur. An average cost of one procedure with therapy is about $15,000.00.

All this misery can stem from one careless fall backwards while standing in the ski line. Following your child at 3 mph can lead to a slow backwards fall and a crippling ACL injury. Nobody has invented a working solution to this one worst injury so frequently caused by a careless moment on downhill skis.

One new attempt to solve this problem is the Lange® ski boot with a rearward pivot ankle segment. A pre-set backward force will release the ankle segment of the boot rearward. However, the boot is still locked into the ski binding. Only twelve pounds of twisting torque on the foot is required to tear an ACL. The Lange® boot solution does not address the release of rotational force on the knee. It addresses the release of a rearward force by the boot on the back of the skier's calf. It is unknown if this system will reduce ACL injuries.

A large portion (perhaps half) of all ACL injuries occur at slow speeds falling backwards. Therefore, a couple of seconds of reaction time exists for a trained skier (either novice or expert) to push an emergency release button on his ski pole handle or other suitable location and totally eject from his skis. By the time the skier hits the ground, he's out of his skis without exerting any rotational torque to his knees. Properly trained skiers using the present invention can reduce the risk of ACL injury by a large percent, perhaps even half. This could mean 25,000 fewer worldwide ACL injuries a year, and a much safer sport overall.

Other uses for this emergency release system (also called a bail out™ system) include easy release for beginners so they can spend less time learning to stand up, and more time skiing. Upside down skiers in a tree hole can quickly release and quickly get out of a dangerous situation.

The basic principle of the present invention is to mount the heel and/or toe release segment of a ski binding on a short track. Pushing the release button energizes a stored force on the ski to move the heel and/or toe binding along the track to a position larger than the ski boot. The result is a size 10 boot in a size 12 binding. The skier is instantly free of his skis.

To remount the skier resets his binding to the loaded and properly sized position, steps in, and skis as usual.

SUMMARY OF THE INVENTION

The main aspect of the present invention is to provide a track on a ski binding element, wherein a remote release button powers the ski binding element to move on the track to a position larger than the skier's proper boot and binding locked position.

Another aspect of the present invention is to provide a transmitter button on a ski pole or other suitable place to activate the movement of the ski binding on the track.

Another aspect of the present invention is to provide a compressed gas canister on the ski to move the ski binding element on the track.

Another aspect of the present invention is to provide a mounting plate with a track to house a toe and heel element of a ski binding.

Another aspect of the present invention is to provide a loud "bang" noise by remote control in order to locate a ski lost in powder.

Another aspect of the present invention is to use colored gas to more easily locate a lost ski in powder by remote control.

The preferred embodiment uses the stored energy of a compressed gas in a housing mounted to a ski binding toe or heel element. A radio signal activated mechanism releases the gas which moves the ski binding element along a track to very rapidly release a skier from his binding.

To reset the binding, the gas from a replacement compressed gas canister is released against a piston which forces the moveable portion of the binding to move along the track so that the distance between the toe piece and heel piece is reduced to the original skiing position.

All normal functions of a modern, forward release ski binding remain intact.

Initial prototypes prove the concept of building a track style release mechanism which can use off-the-shelf ski bindings.

Future models of the track style release binding could be factory built with the ski binding installed.

Other aspects of this invention will appear from the following description and appended claims, reference being made to the accompanying drawings forming a part of this specification wherein like reference characters designate corresponding parts in the several views.

BRIEF DESCRIPTION OF THE INVENTION

Figure 1:
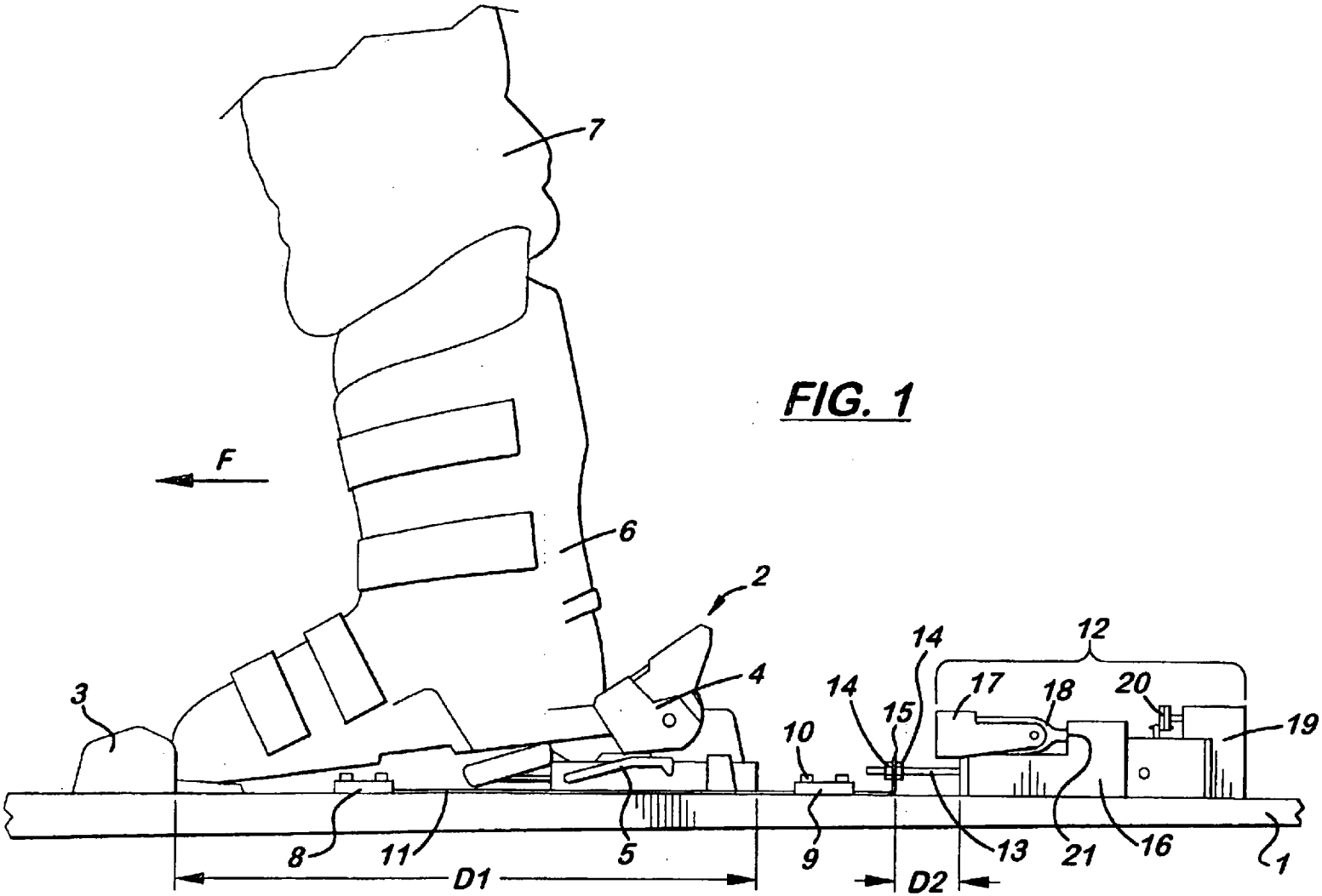
FIG. 1 is a right side plan view of a gas operated release embodiment, the preferred embodiment.

Referring first to FIG. 1 a downhill ski 1 has a traditional forward release binding system 2 comprising a toe release mechanism 3, a heel release mechanism 4 and a snow brake 5. When the skier 7 falls forward his boot 6 moves forward in direction F thereby releasing the binding system 2 in a known manner. Upon release the snow brake 5 is thrust downward.

The heel release system mounts the heel release system 4 on a track 11. Anchors 8,9 hold the track 11 on the ski 1 and enable the track 11 to move forward and backward. Fasteners 10 hold the anchors 8,9 to the ski 1.

The heel release mechanism 12 has a piston arm 13 that is shown holding the heel release system 4 in the forward skiing position. The binding system 2 functions as a standard ski release system. The piston arm 13 connects to a flange 15 at the rear of the track 11. A hole (not shown) in the flange accepts the piston arm 13. Adjustment nuts 14 clamp the piston arm 13 to the flange 15.

The body 16 of the release mechanism 12 has a gas cylinder chamber filled with compressed gas (preferably $CO_2$) which forces a piston forward as shown.

The principle of the release system of the present embodiment uses the concept that moving the heel release mechanism 4 a distance D2 (or a portion thereof) opens the binding system 2 to a size too big to hold the boot 6. The boot 6 will release in every direction especially backward when the binding system 2 is opened via the track 11. The distance D1 is the proper distance between the toe and heel release members to fit the boot 6. In prototype mode the distance D2 is about a half inch to about one inch.

The release mechanism 12 shown is a $CO_2$ gas cartridge activated device. The skiing position shown has a gas cylinder cartridge 18 in the housing 16, wherein the lever arm 17 has pushed the head of the cartridge 18 into the puncture pin 21 inside the housing. A piston (FIG. 3,30) is forced forward. Thereby holding the track 11 in the skiing position. This is a failsafe design in that a failure in the gas system results in the track moving backward, wherein the skier can't lock into his bindings.

For a release (either emergency or normal) a radio signal is received by the receiver 19. A linear motor or equivalent device such as a solenoid raises a plug 20 and releases the compressed gas from the housing 16. Then a powerful spring (FIG. 3, 42) forces the piston (FIG. 3, 30) backward, quickly releasing the boot 6 from the binding system 2.

Figure 2:
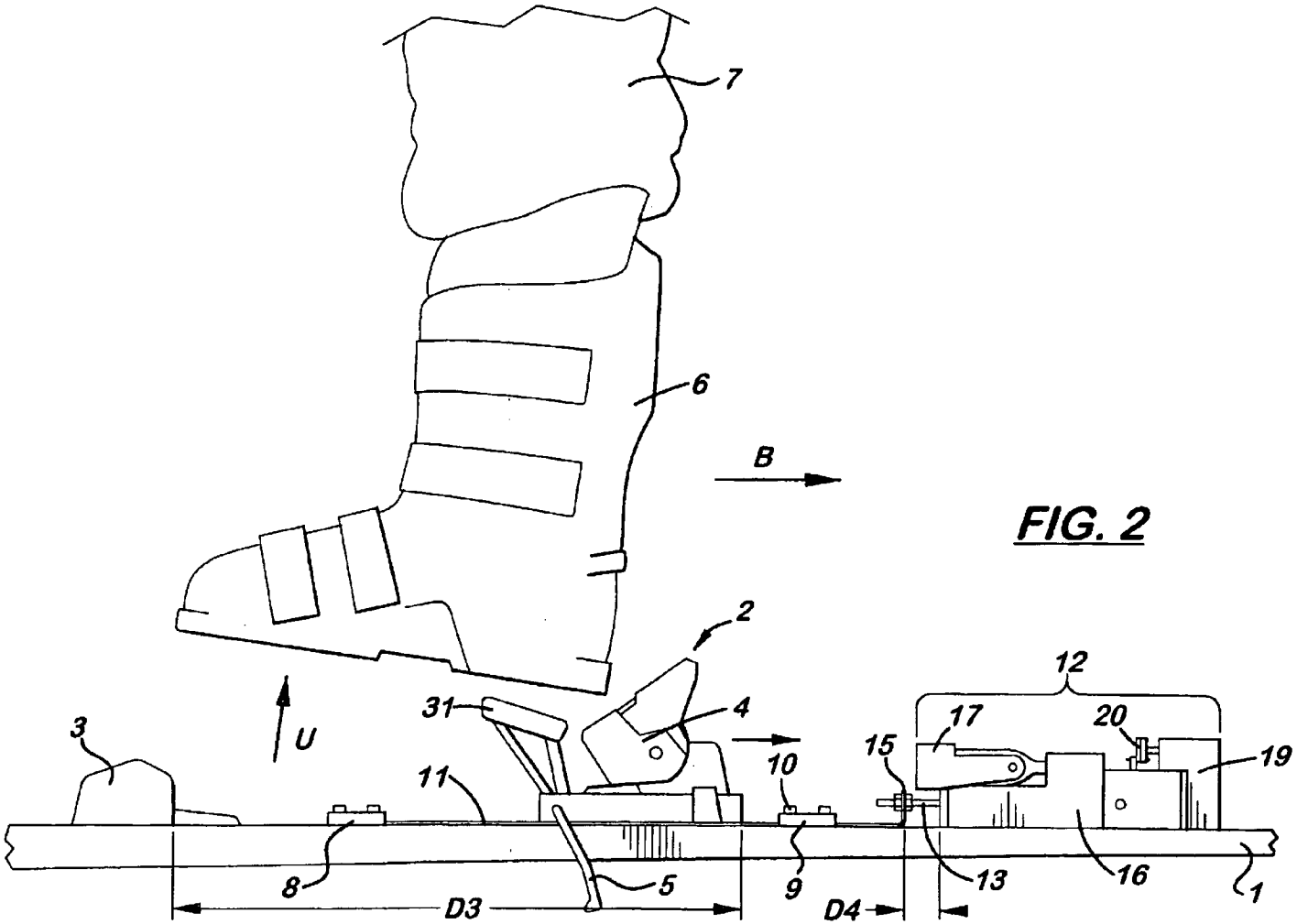
FIG. 2 is the same view as FIG. 1 with the ski boot released.

Referring next to FIG. 2 the skier 7 has hit his release button (preferably located on his ski pole handle). At release time the skier was leaning back. His boot has released up U and back B. Thus, an injury to the ACL has been avoided. Prototypes prove this release, even in a fully loaded (backward) fall position, will occur before the skier hits the ground.

At release time the snow brake 5 has pivoted down via the brake release pedal 31 in a known manner. Distance D3 is too long to hold the boot 6 in the binding system 2. Distance D4 is less than D2, and is a design choice. The prototype worked at D2–D4=one inch or less.

Figures 3, 4, 5:
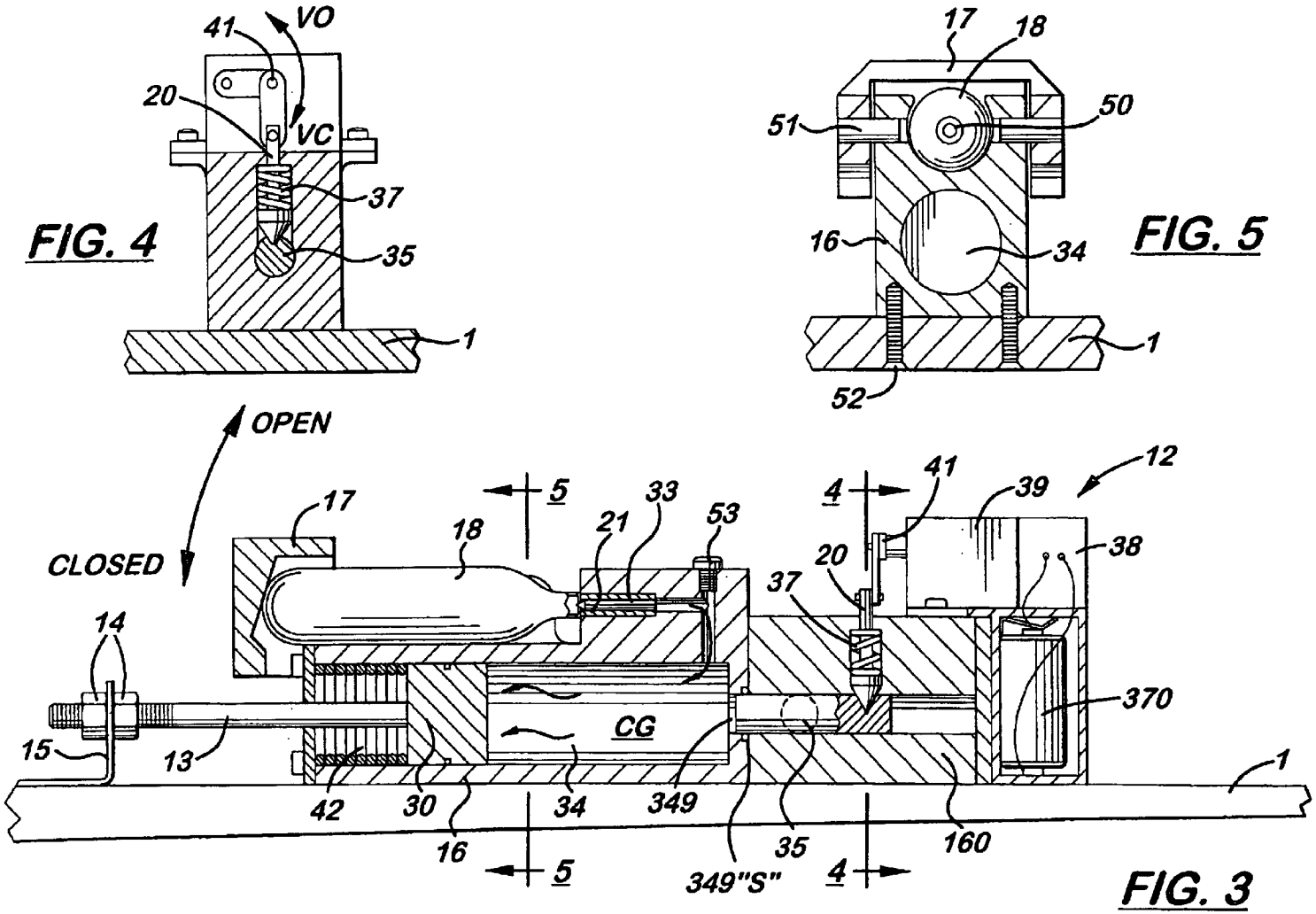
FIG. 3 is a longitudinal sectional view of the gas operated release mechanism.
FIG. 4 is a cross sectional view taken along line 4—4 of FIG. 3.
FIG. 5 is a cross sectional view taken along line 5—5 of FIG. 3.

Referring next to FIGS. 3,4,5 the prototype gas release system 12 is shown. The body 16 houses a plunger 35 for controlling the compressed gas CG. The lever arm 17 can be pivoted to the open and closed positions. The opening spring 42 has been compressed by the force of the compressed gas CG in the cylinder 34 on the piston 30. The channel 33 provides a fluid communication with the cylinder 34. An optional maintenance cap 53 is shown.

Figure 6:
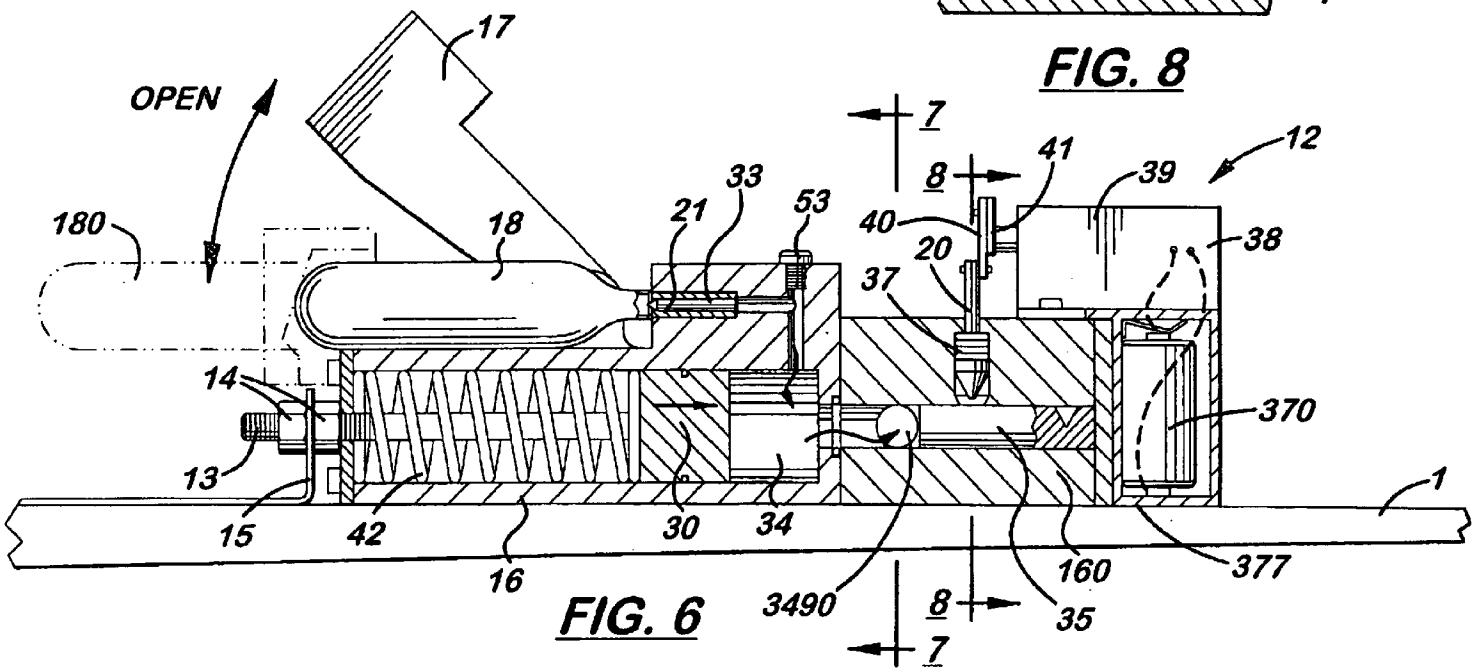
FIG. 6 is the same view as FIG. 3 with the gas cylinder unopened.
Figure 11:
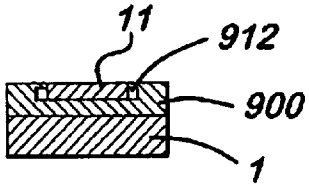
FIG. 11 is a cross sectional view taken along line 11—11 of FIG. 10.
Figure 10:
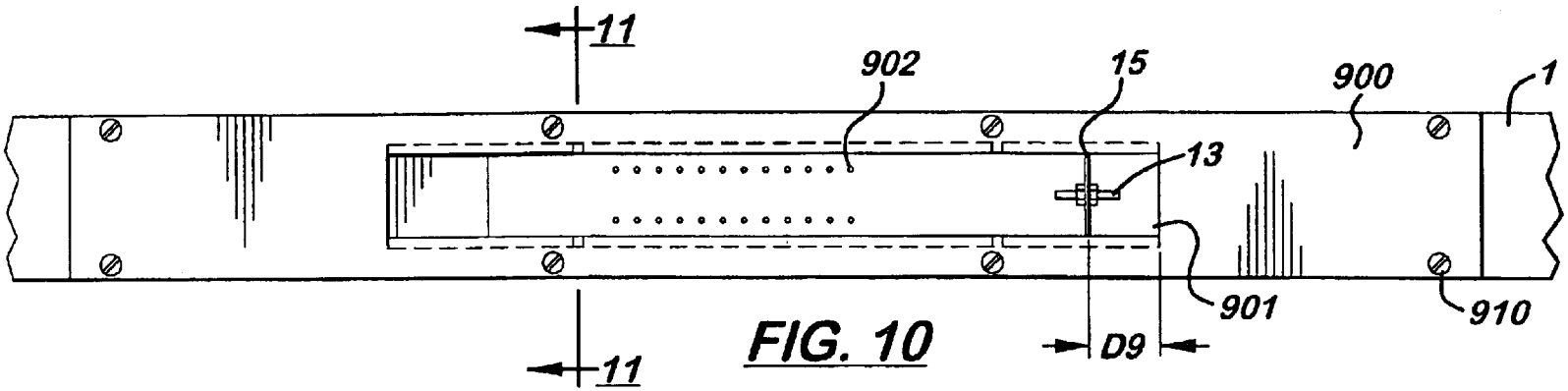
FIG. 10 is a top plan view of the plank mount embodiment.
Figure 9:
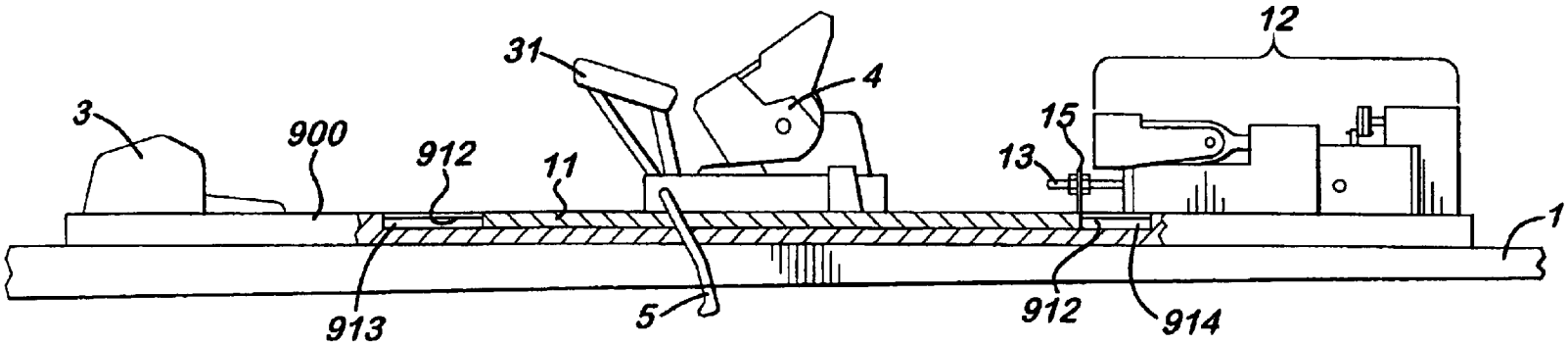
FIG. 9 is a right side partial sectional view of a plank mount embodiment.
Figure 12:
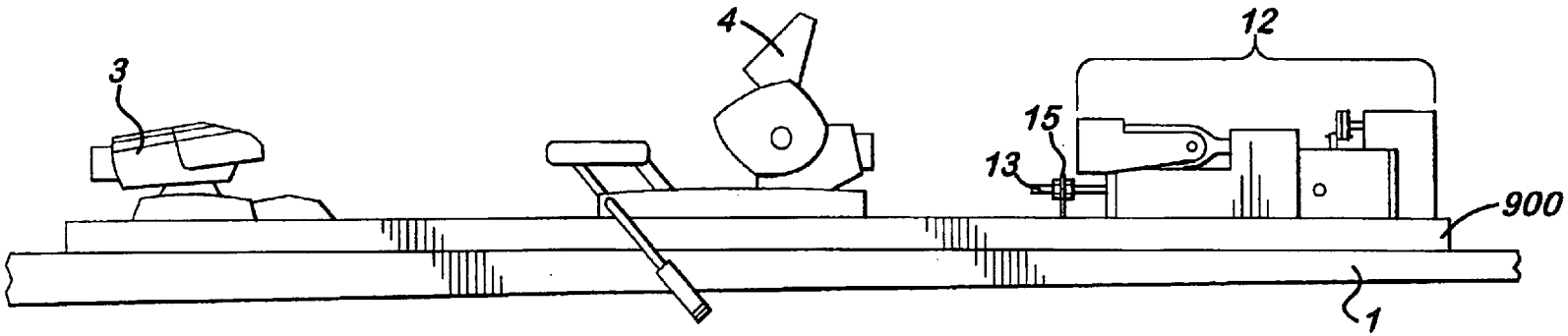
FIG. 12 is a right side plan view of the plank mount embodiment.

To release the skier from the binding the spring 42 needs to be released, and cylinder 34 needs to be discharged. This is done by retracting plug 20 from detent 37 in plunger 35. Gas in cylinder 34 pushes thru port 349 moving plunger 35 to rear of port 349 breaking seal at "O" ring 349"S" and exposing exhaust port 3490, as shown in FIG. 6. This allows gas in cylinder 34 to escape to open atmosphere via vent 3490 and release all pressure on spring 42. Since piston arm 13 is attached to flange 15 by adjusting nuts 14 (two each), it moves track 11 and removes all holding power from the heel release 4. This immediately disconnects ski boot 6 from ski 1. As gas exits from port 3490 the tone of sound and decibel loudness may be greatly changed by size and design of port 3490.

When the cylinder 34 needs to be discharged, plug 20 is pulled up by a linear motor (not shown) in the actuator/receiver housing 39. The battery 370 powers both the radio receiver (not shown) and the linear motor. When the linear motor is in the valve closed VC position as shown in FIG. 4, the cylinder outlet 349 is closed by the plunger 35. The plunger 35 is held in the closed position by the plug 20 that fits into detent 37. A linkage 41 to the linear motor moves the plug 20 from the valve open VO to the valve closed VC positions.

In FIG. 5 the head 50 of the $CO_2$ cartridge 18 can be seen. It is pierced by the puncture pin 21 when the lever arm 17 is closed manually. Bolts 52 secure the housing 16 to the ski 1. The weight of the heel release mechanism 12 in the prototype was 1½ pounds, which did not effect skiing. The radio transmitter/receiver and linear motor of the prototype were taken from a radio controlled model airplane.

Figure 8:
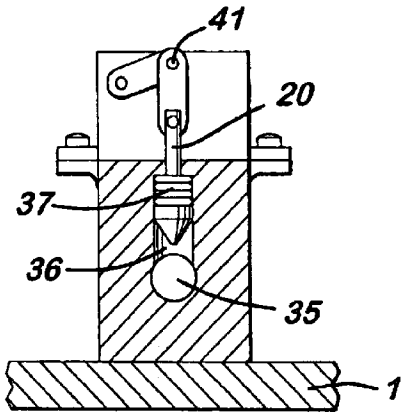
FIG. 8 is a cross sectional view taken along line 8—8 of FIG. 6.
Figure 7:
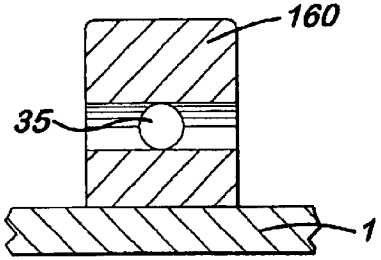
FIG. 7 is a cross sectional view taken along line 7—7 of FIG. 6.

Referring next to FIGS. 6,7,8 the release system 12 has been released via the receiver 38 activating the linear motor to pull the linkage 41 to the valve open VO position. Compressed gas has escaped through the cylinder outlet 349 and port 3490. A design choice allows a loud "bang" type noise (to find skis in powder) or a quiet mode. Also a colored gas can be used to help find skis in powder.

For re-charging the system a new cartridge 180 is shown in dots. The lever arm 17 is shown open.

Referring next to FIGS. 9,10,11,12 the equivalent system to that shown in FIGS. 1–8 has been modified to include a mounting board 900 that holds all the system components. The mounting board 900 is screwed to the ski 1 with screws 910. A groove 912 on the top of the mounting board 900 houses the track 11. The track 11 has the same flange 15. The ends of the groove at 913,914 are sized to allow the proper movement of track 11. Holes 902 provide for proper installation of the heel release 4 based on size. This mounting board could be used for the preferred embodiment of FIGS. 1–8.

Figure 13:
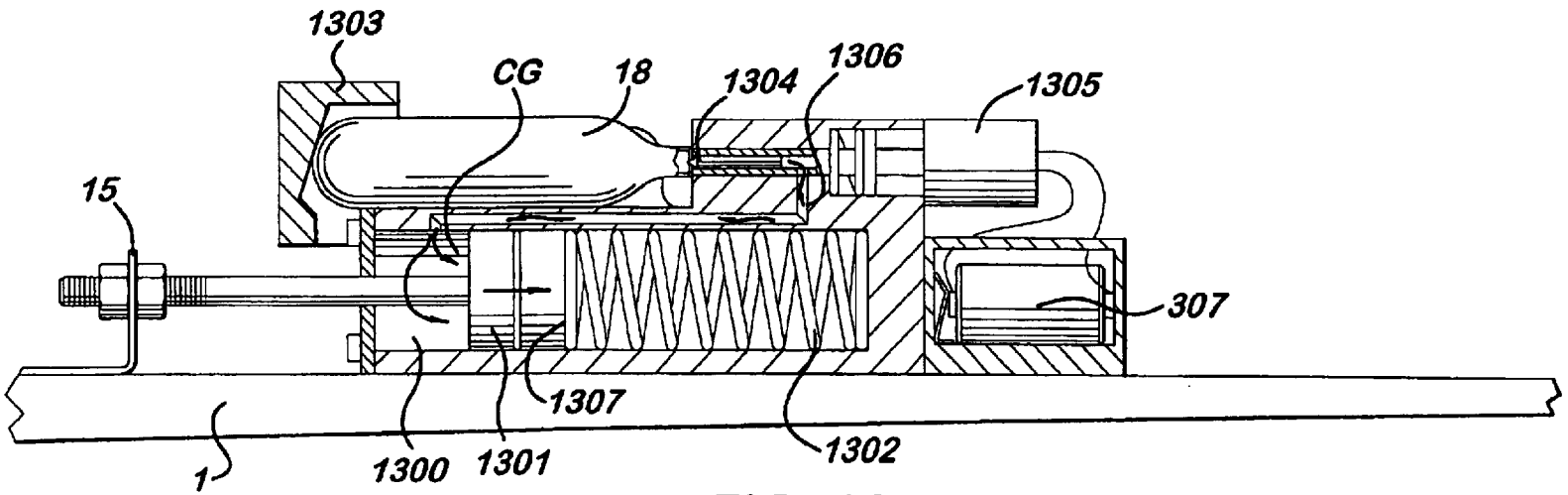
FIG. 13 is a longitudinal sectional view of an alternate embodiment gas release mechanism.

Referring next to FIG. 13 a reverse action gas release system is shown wherein the track 11 and flange 15 are the same as the earlier embodiment. In this case the skiing position is shown wherein the spring 1302 holds the piston 1301 all the way forward as shown. No compressed gas has been discharged yet.

The receiver and linear motor unit 1305 is activated by the same radio signal as the earlier embodiment. The linear motor unit 1305 forces a probe 1304 into the head of the compressed gas cylinder 18. Compressed gas CG flows through the channel 1306 to the cylinder 1300, thereby forcing the piston 1301 and the flange 15 backward and releasing the skier (normally without a bang). The piston ring 1307 is designed to slowly release the compressed gas after release (in perhaps a minute). For loading up the gas canister 18 a latch type door 1303 may be used.

Figure 14:
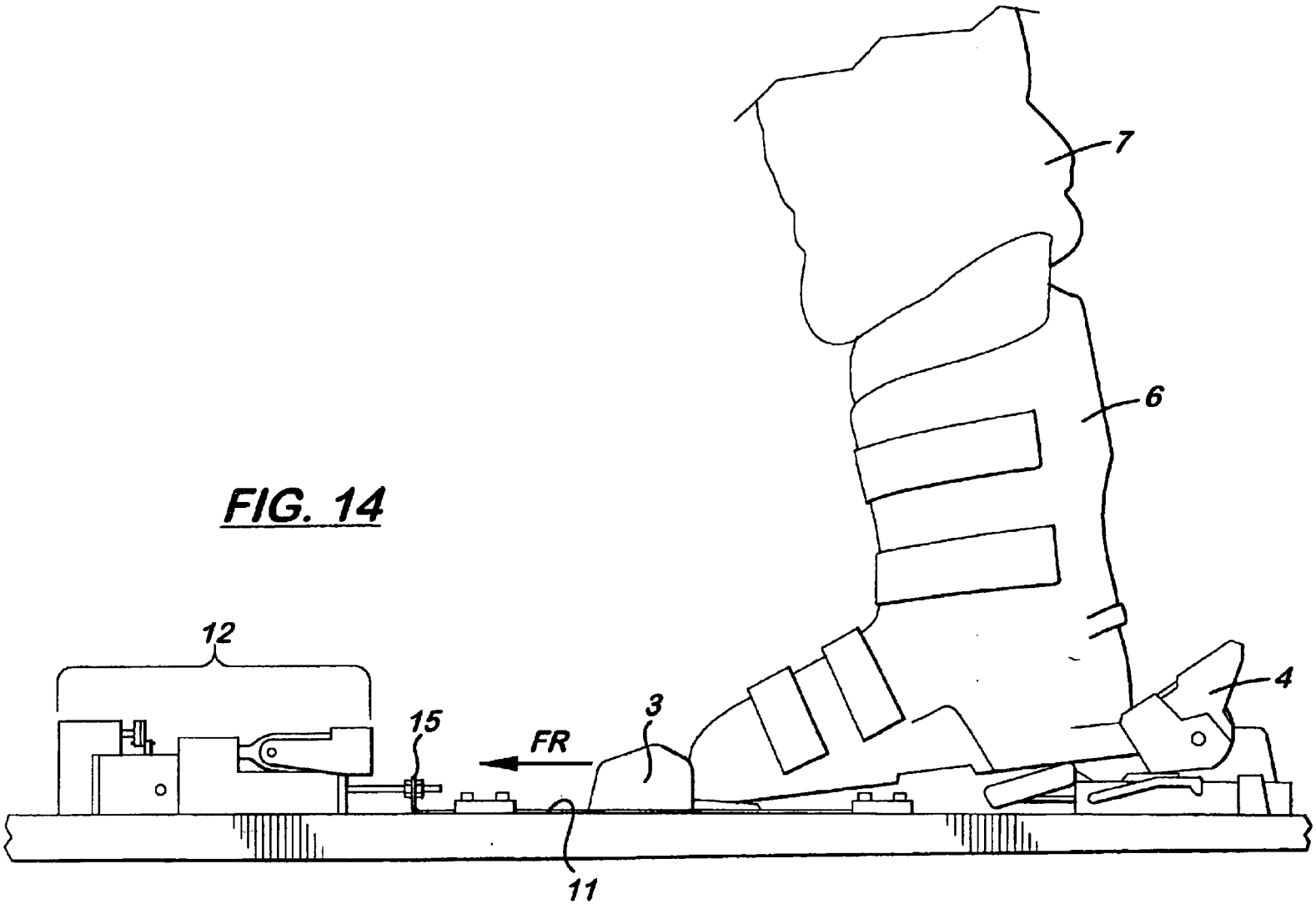
FIG. 14 is a right side plan view of a toe piece track release embodiment.

Referring next to FIG. 14 a moving toe piece embodiment is shown. The heel piece 4 remains fixed while the toe piece 3 is pulled forward FR by the flange 15 in a like manner as the earlier embodiments. In this case the ski moves backward relative to the release system 12, where in the heel mounted release systems the ski moves forward.

Figure 16:
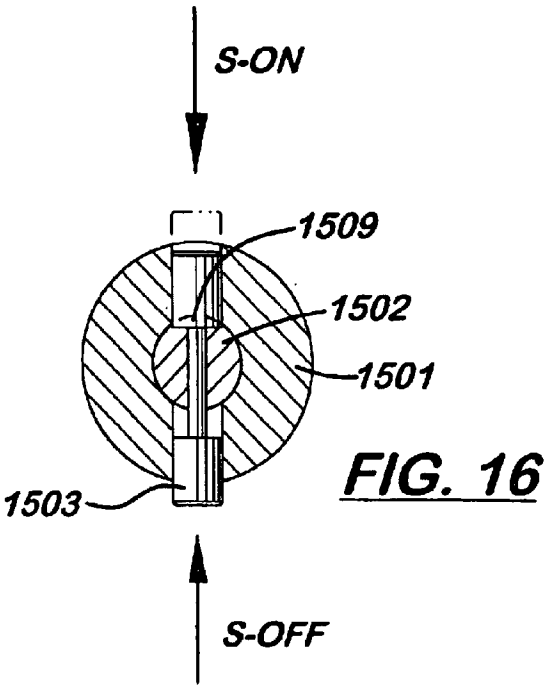
FIG. 16 is a cross sectional view taken along line 16—16 of FIG. 15.
Figure 15:
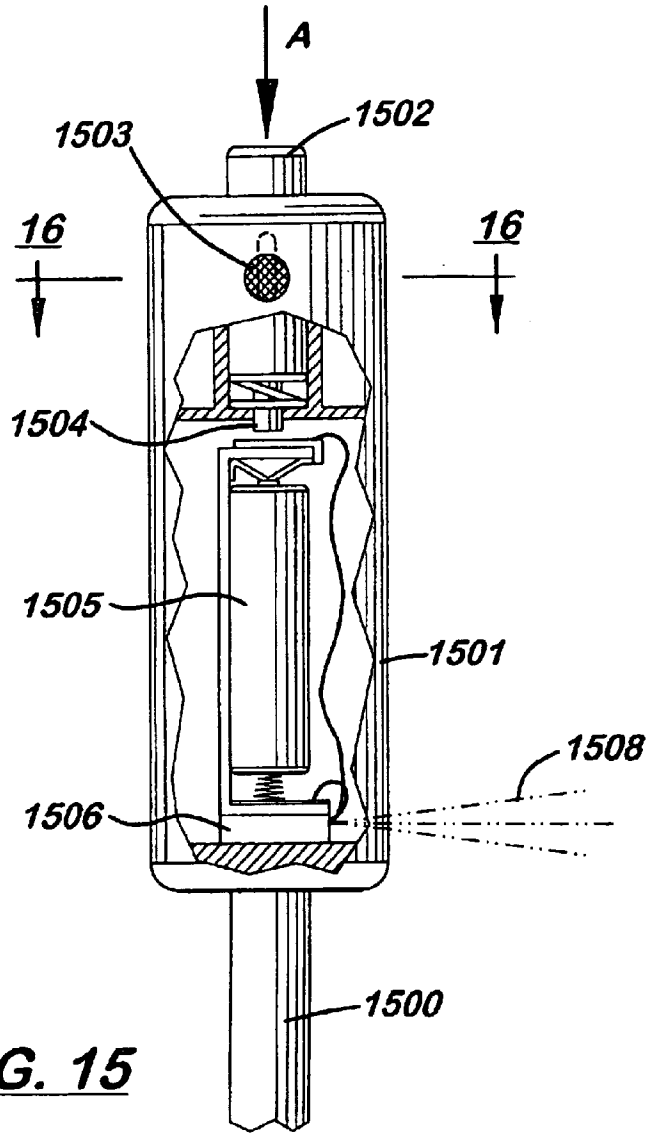
FIG. 15 is a partial cutaway view of the ski pole handle transmitter.

Referring next to FIGS. 15,16 the ski pole 1500 has a handle 1501. An activator button 1502 is mounted on top of the handle for thumb activation. Accidental discharges are prevented by safety switch 1503. The safety on S-ON position prevents the depressing of button 1502 because segment 1509 inserts into a hole in button 1502, locking it. In the safety off position S-OFF the button 1502 is free to be activated. Normally the skier would move to the S-OFF position only during a ski run, not on the lift or during transport.

For release the button 1502 closes switch 1504. The battery 1505 energizes the transmitter 1506 which sends signals 1508 to the ski mounted receiver. Known multiple frequency methods are used to create a large number of different frequencies in the field so as to prevent one skier from releasing another's bindings. Short range transmitters also minimize this risk.

Figure 17:
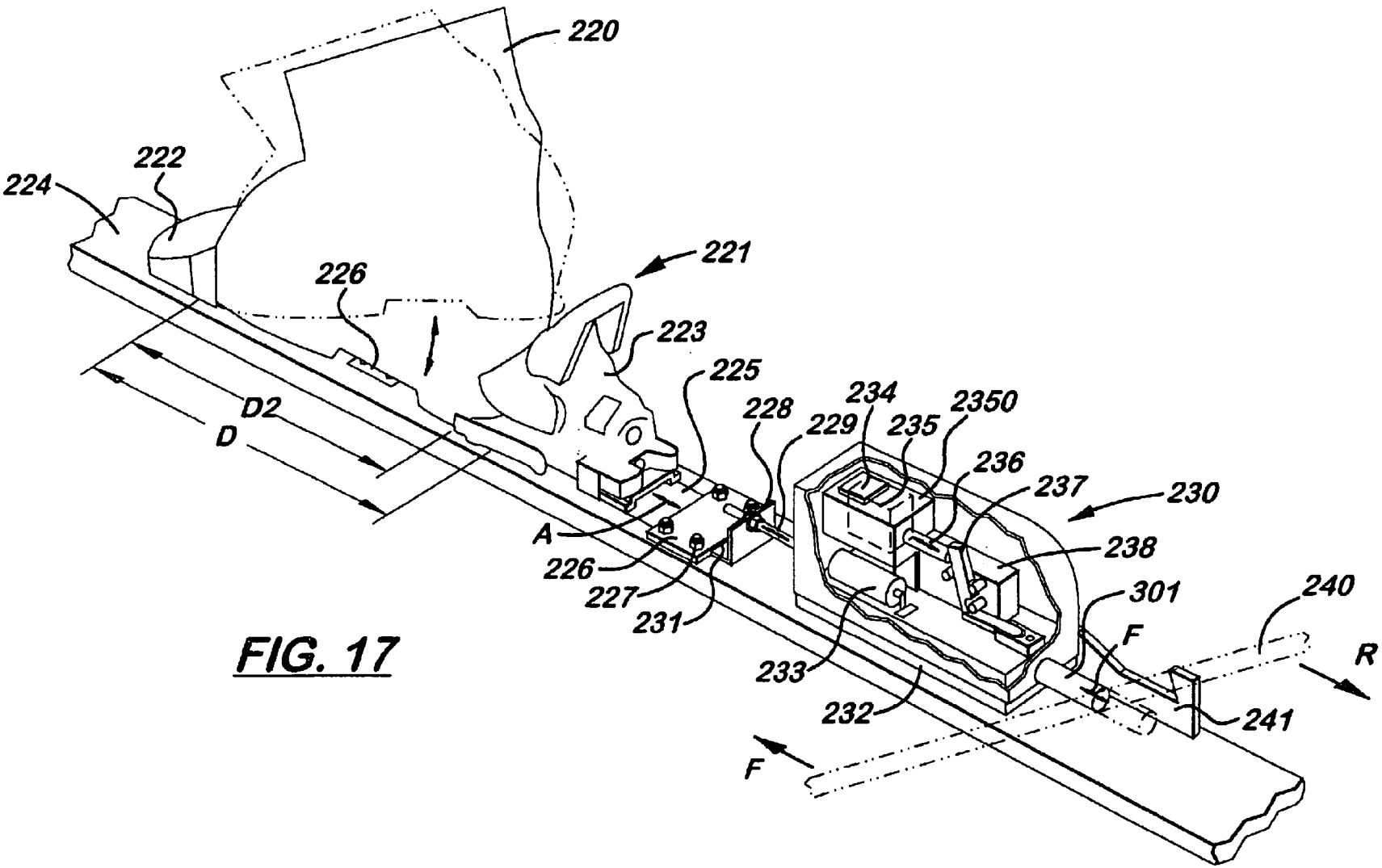
FIG. 17 is a top perspective view of the spring release mechanism embodiment.

Referring next to FIG. 17 a ski boot 220 is shown stepping into a prior art downhill ski binding 221 which consists of a toe piece 222 and a heel piece 223. The dotted lines of the ski boot 220 show the traditional downward movement of the ski boot 220 for locking into the ski binding 221. The toe piece 222 is screwed into the ski 224 in a known manner. The proper mounting distance between the toe piece and heel piece for boot 220 is shown as D2 (distance for skiing).

The heel piece is mounted to the track 225 instead of the ski 224. The track 225 can be a flat metal strip which slides under anchors 226 which are fastened to the ski with screws (or bolts) 227. A notch 231 under the anchors 226 receives the moveable track 225. When the spring release mechanism 230 pulls the track rearward for a release, (shown by arrow) then the distance between the toe and heel pieces increases to D (distance for release).

Figure 25:
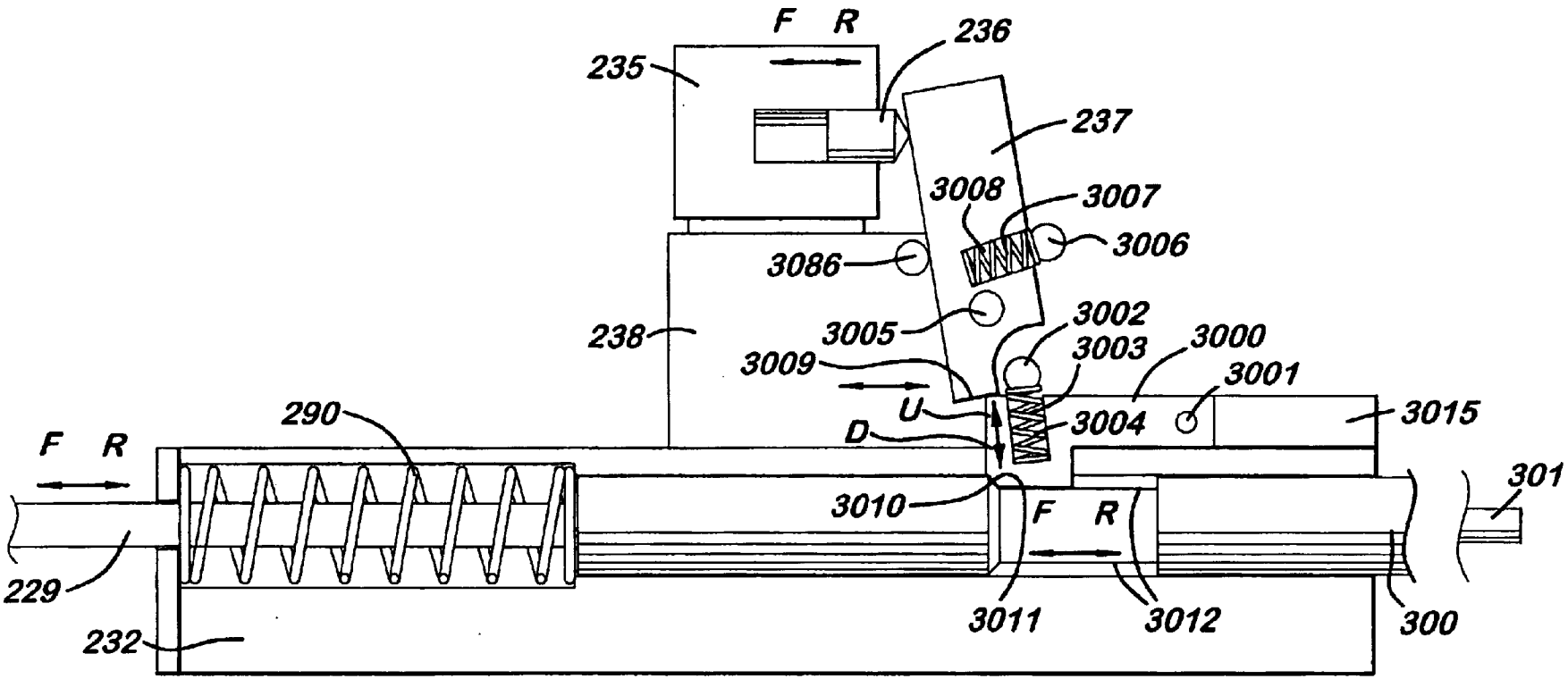
FIG. 25 is a same view as FIG. 24 with the spring housing locked.

The track 225 has a rear flange 228 which is connected to a shaft 229, which in turn is directly attached to a central piston (FIG. 25, 300). The spring release mechanism consists of a main housing 232, a receiver 234, a solenoid 235, an electronics housing 2350, a plunger 236, a trigger 237, and a trigger support 238. The outer case for the above components has been removed.

Figure 24:
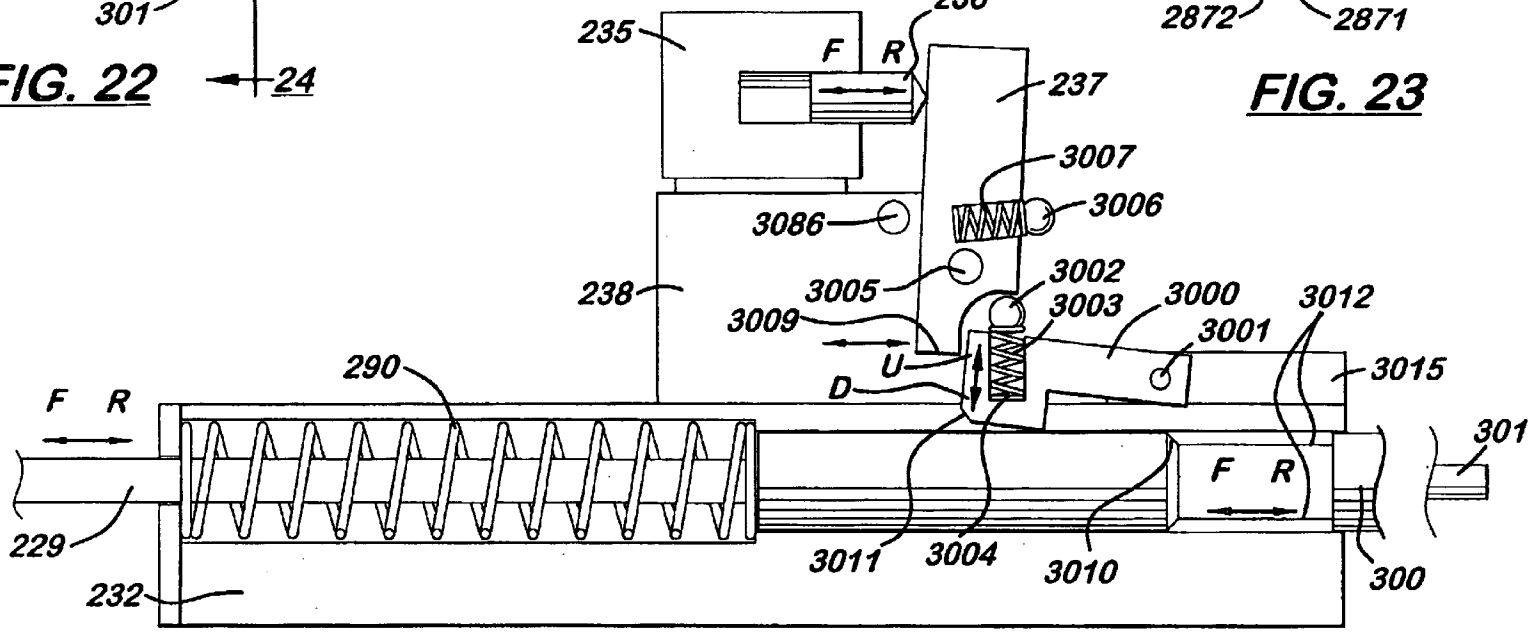
FIG. 24 is a longitudinal sectional view of the spring housing (released) of the spring release mechanism embodiment taken along line 24—24 of FIG. 22.

In operation a skier cocks the spring release mechanism to the ski position shown in FIG. 25. A lever 240 (such as the tip of a ski pole) is used to push the central piston crank arm 301 forward in direction F. This is accomplished by pulling the lever 240 rearward in direction R against the fulcrum 241. The fulcrum is shown as a simple piece of metal extending rearward from the main housing 232. Now the traditional ski binding 221 functions in the traditional manner to release upon a forward force from the ski boot 220. However, as shown in FIGS. 15,16 a signal 1508 (preferably a radio signal) is generated by a skier to demand the instant release of his bindings. The receiver 234 receives the signal 1508 and activates the solenoid 235 to extend the plunger 236, thereby tripping the trigger 237. When the trigger 237 is tripped, the stored energy of the main spring (FIG. 24, 290) forces the central piston (FIG. 24, 3000) to the release position as shown in FIG. 24. The track 225 is pulled rearward in direction R, and the distance between the toe and heel pieces increases to distance D. In prototype mode the difference between D and D2 is approximately one inch.

Figure 18:
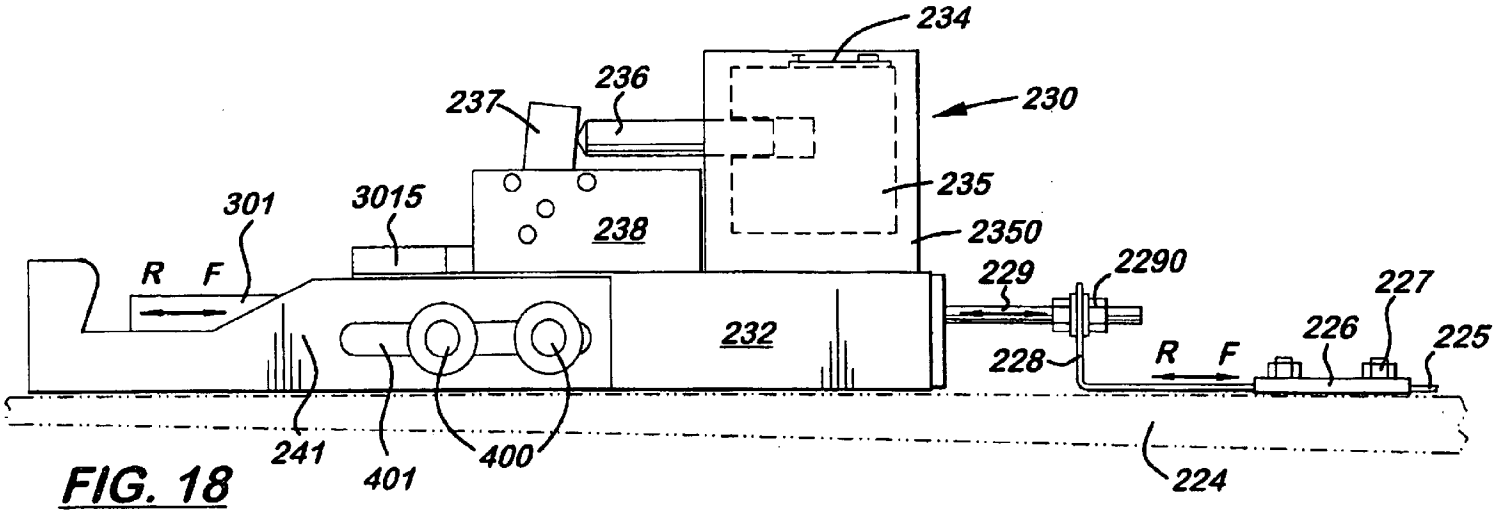
FIG. 18 is a left side plan view of the spring release mechanism embodiment.
Figure 19:
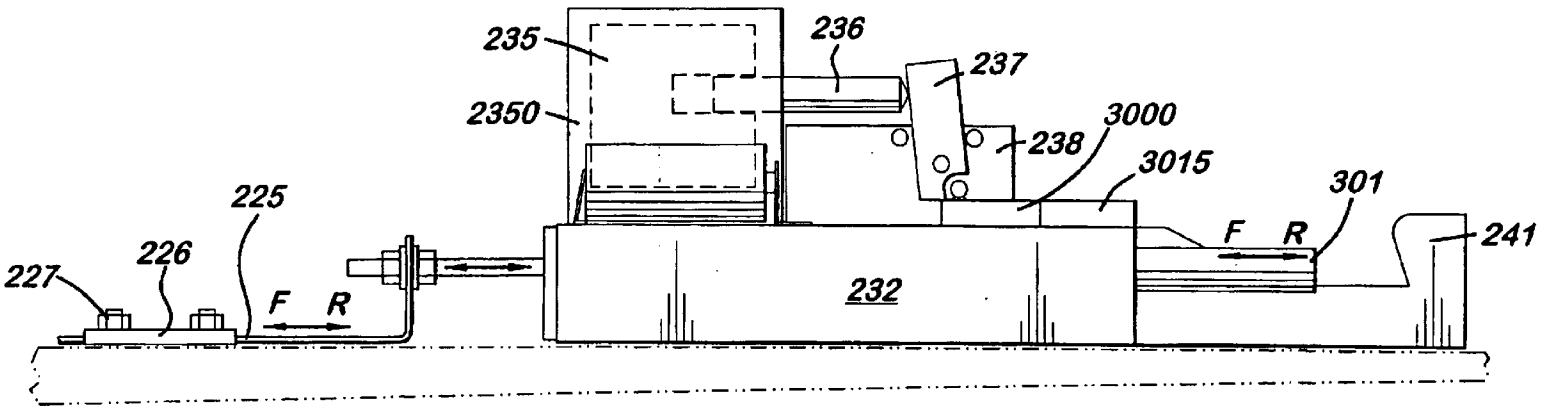
FIG. 19 is a right side view of the spring release mechanism embodiment.
Figure 20:
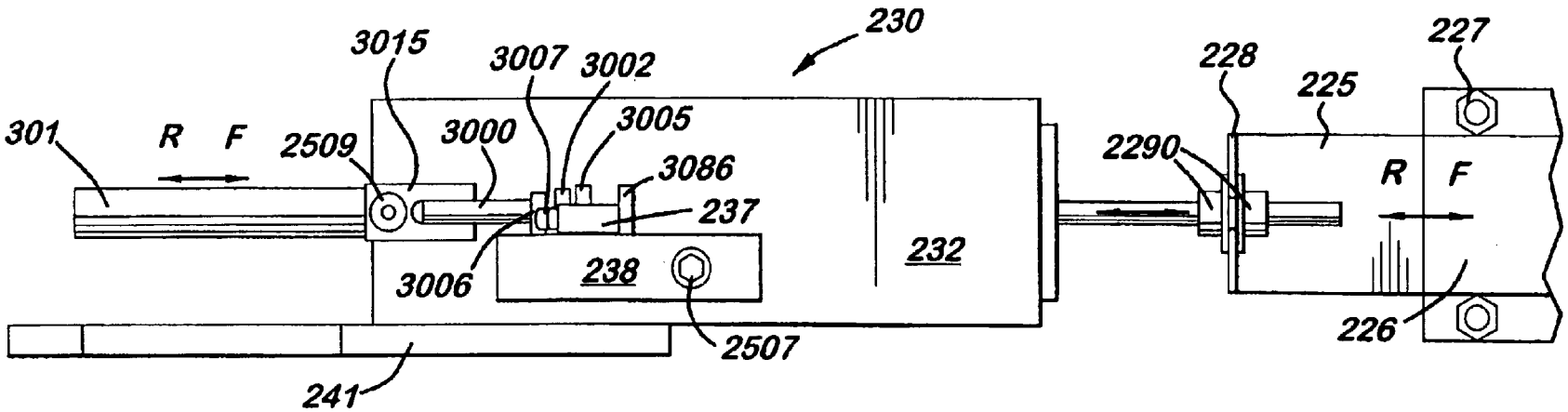
FIG. 20 is a top plan view of the spring release mechanism embodiment.
Figure 21:
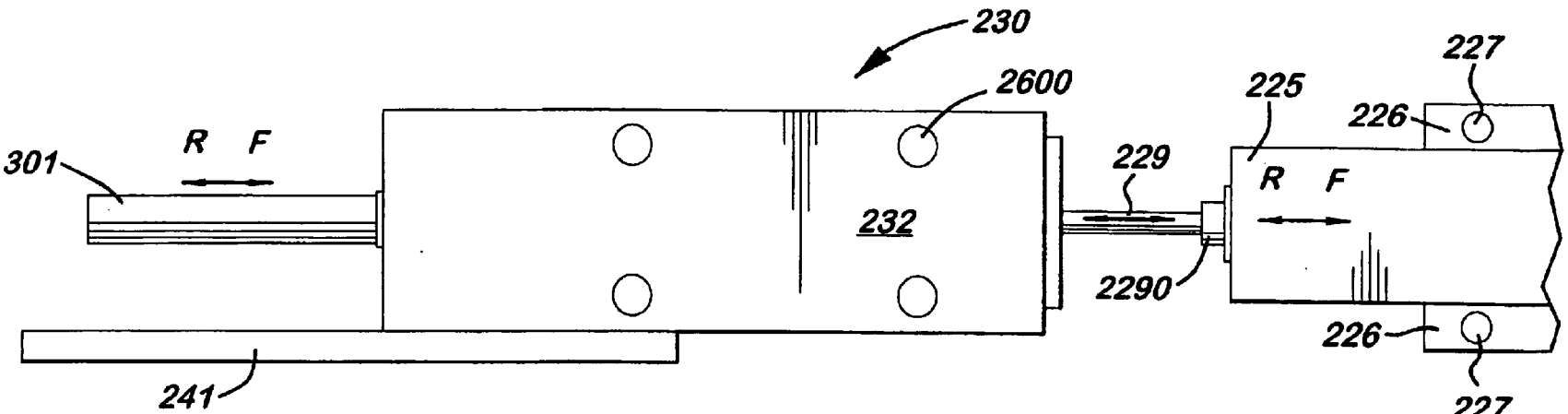
FIG. 21 is a bottom plan view of the spring release mechanism embodiment.
Figure 23:
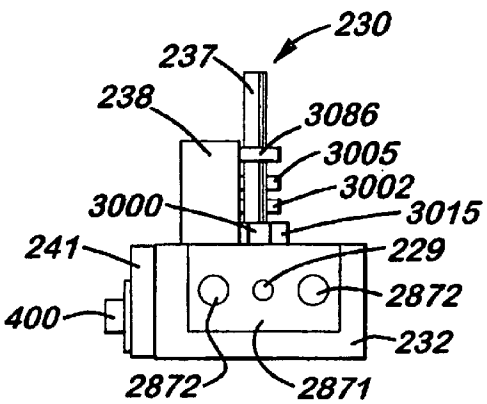
FIG. 23 is a front plan view of the spring housing of the spring release mechanism embodiment.
Figure 22:
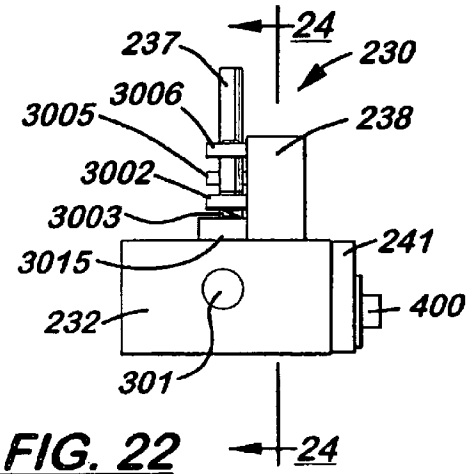
FIG. 22 is a rear plan view of the spring release mechanism embodiment.

Referring next to FIGS. 18,19 the external appearance of the trigger 237 and its related functional parts is shown in plan view. The housing 232 forms a base for the fulcrum 241. A slot 401 allows adjustment of the rearward positioning of the fulcrum 241 with bolts 400. The solenoid is mounted inside the electronic housing 2350, said housing counteracts the electronic force generated to move the plunger 236 rearward to trigger the trigger 237. Bolts 2290 secure the shaft to the flange 228. The trigger 237 controls the movement of a sear (also called a locking pin) 3000. A base 3015 forms a pivot for the sear 3000 to pivot from.

Referring next to FIGS. 20,21,22,23 the solenoid and electronic components have been removed to better show the mechanical parts. The spring housing 232 has mounting holes 2600 on the bottom for attachment to a ski. A bolt 2507 secures the trigger housing 238 to the spring housing 232. A bolt 2509 secures the sear base 3015 to the spring housing 232. Pin 3086 is a forward stop for the trigger 237. Pin 3005 is a pivot for the trigger 237. Pin 3006 is a stop for spring 3007 which pushes the trigger 237 over the sear 3000 in the cocking operation. Pin 3002 is a stop for spring 3003 which pushes the sear 3000 into the groove 3012 which is located on the peripheral surface of central piston 300.

The operation of the spring mechanism 230 is best seen in FIGS. 24,25. The electronic parts have been removed. The technical challenge is to store enough energy in the spring 290 to violently pull the track 225 rearward on demand to release. The further challenge is to work with the limited power available with a lightweight battery pack on board the ski. Too much added weight is not practical for downhill skis. The solution is a sear 3000 which has a locking corner 3011 which is forced into a locking engagement with a locking edge 3010 of the groove 3012 on the outside of the central piston 300. The spring 3003 forces the sear downward in direction D when the spring is fully compressed. This locked and ready to ski mode is shown in FIG. 25. The spring 3007 forces the trigger 237 to lock the sear down.

When the skier pushes his release button to send a (preferably radio) signal to the receiver 234, the solenoid (or linear motor) is powered, thereby forcing plunger 236 against the trigger 237. The trigger 237 has a pivot pin 3005, and so the plunger 236 moves the locking bottom edge 3009 off the top of the sear, thereby allowing the spring 3003 to raise the sear around its pivot pin 3001. As this occurs the locking surfaces 3010,3011 are released, and the spring 290 violently discharges its stored energy and pulls the track 225 rearward. This rearward force does overcome both the force of the weight of the skier as well as the force of any ice and debris that has collected on the ski. The release mode is shown in FIG. 24. The cavity 3004 in the sear 3000 holds the spring 3003.

Although the present invention has been described with reference to preferred embodiments, numerous modifications and variations can be made and still the result will come within the scope of the invention. No limitation with respect to the specific embodiments disclosed herein is intended or should be inferred.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

We claim:

1. A ski binding release system comprising:

a track for receiving a ski binding member;

said ski binding member being a member of a forward release binding system having a toe release mechanism, a heel release mechanism and a snow brake that is thrust downward upon a release of the forward release binding system;

wherein an automatic release of the forward release binding system maintains a constant mounting distance between the toe release mechanism and the heel release mechanism;

a remote transmitter;

a receiver mountable on a ski with an actuator connected to the track;

wherein a manual activation of the remote transmitter activates the receiver which in turn activates the actuator to move the track, thereby moving the ski binding member;

wherein the track further comprises a flat rigid member having a forward and a rear anchor for attachment to a ski;

wherein the flat rigid member slides in the anchors;

wherein the flat rigid member is controlled by the actuator; and wherein the actuator further comprises a prechargeable gas chamber powering a piston connected to the track which biases the track in a ski position maintaining the constant mounting distance, and a receiver to receive a remote signal and release the actuator from a ski position to a release position by enlarging the mounting distance between the toe release mechanism and the heel release mechanism.

2. The system of claim 1, wherein the receiver, the actuator, the prechargeable gas chamber and the piston are all housed together in a single housing.

3. An improvement to a forward release ski binding release system, said ski binding release system having a toe piece with a release mechanism and a heel piece with a release mechanism to hold a boot, and a snow brake that is thrust downward upon a release of the forward release ski binding system wherein an automatic release of the forward release ski binding release system maintains a constant mounting distance between the toe piece and the heel piece, the improvement comprising:

a track connected to the heel piece;

an actuator connected to the track which increases the mounting distance between the toe piece and the heel piece on demand from a remote signal;

wherein the actuator further comprises a prechargeable compressed gas cylinder having a piston connected to the track; and wherein the compressed gas cylinder further comprises a plug which is connected to a linkage, wherein a receiver receives the remote signal and powers the linkage to unplug from the prechargeable compressed gas cylinder to allow a spring to move the actuator from a ski position to a release position by enlarging the mounting distance between the toe piece and the heel piece.

4. The improvement of claim 3, wherein the plug blocks an outlet tube which emits a loud noise upon release of the plug.

5. The improvement of claim 3, wherein a gas in the compressed gas cylinder further comprises a color to assist locating a lost ski in powder upon the release of the compressed gas.

6. The improvement of claim 3, further comprising a $CO_2$ cartridge connected to the prechargeable compressed gas cylinder to provide a source of compressed gas.

7. The improvement of claim 6, further comprising a $CO_2$ cartridge housing and puncture mechanism to charge the compressed gas cylinder.

8. The system of claim 3, wherein the actuator, the prechargeable compressed gas cylinder, the piston, the plug and the linkage are all housed in a single housing.

9. A ski binding release system comprising:

a toe and a heel piece forming a forward release binding system having a toe release mechanism and a heel release mechanism and snow brake that is thrust downward upon a release of the forward release binding system, wherein an automatic release of the forward release binding system maintains a constant mounting distance between the toe release mechanism and the heel release mechanism;

a mechanism having a gas actuator to enlarge the mounting distance between the toe release mechanism and the heel release mechanism on demand from a remote signal;

said mechanism having a housing which contains a connector to a track and having a prechargeable gas chamber with a piston which releaseably forces the track against either the toe or the heel piece, and having a receiver to receive a remote signal to release a gas pressure from the gas chamber;

said track having mounted on it either the toe or the heel piece; and wherein a manual activation of a remote transmitter causes the remote signal to be received by the receiver to increase the mounting distance.

10. The system of claim 9, wherein the transmitter is contained in a ski pole to activate the receiver.

11. The system of claim 10, wherein the transmitter further comprises a safety switch to prevent an accidental transmission.

12. The system of claim 9, further comprising a mounting plate to house the toe piece and its release mechanism, the track, the heel piece and its release mechanism and'the actuator, said mounting plate having a hole for mounting to a ski.

13. The system of claim 9, wherein the mechanism, the gas actuator, prechargeable gas chamber, the piston and the receiver are all housed in a single housing.

14. A ski binding release system comprising:

a toe and a heel piece designed to have a mounting distance therebetween to secure a ski boot;

said toe and heel pieces being parts of a forward release binding system wherein an automatic release of the forward release binding system maintains a constant mounting distance between the toe and heel pieces and releases a snow brake downward;

an extension mechanism to manually via remote control release the ski boot by enlarging the mounting distance on demand by a remote signal;

said extension mechanism having a housing to contain a prechargeable gas chamber with a piston, a connector to a track which is biased by the prechargeable gas chamber and piston, and a receiver which controls a release of a gas pressure from the gas chamber upon receipt of the remote signal; and wherein the track further comprises a flat rigid member having a forward and a rear anchor for attachment to a ski, wherein the flat rigid member slides in the anchors.

15. An improvement to a forward release ski binding release system, said forward release ski binding release system having a toe piece with a release mechanism and a heel piece with a release mechanism to hold a boot, wherein an automatic release of the forward release ski binding release system maintains a constant mounting distance between the toe piece and the heel piece and releases a snow brake downward; the improvement comprising:

a track connected to the toe piece;

an actuator connected to the track which increases a mounting distance between the toe piece and the heel piece on demand from a remote signal;

wherein the actuator further comprises a housing containing a gas loaded piston having a ski position with the gas compressed, and a release position with the gas released, said piston controlled by a receiver which receives a remote signal ; and wherein the ski boot is released by causing the toe piece to move to a larger distance from the heel piece via the track.

16. A ski binding release system comprising:

a toe and a heel piece;

said toe and heel pieces each being members of a forward release binding system having a toe release mechanism, a heel release mechanism and a snow brake that is thrust downward upon a release of the forward release binding system, wherein an automatic release of the forward release binding system maintains a constant mounting distance between the toe and the heel piece;

a mechanism having an actuator to enlarge the mounting distance between the toe and the heel piece on demand from a remote signal; and said mechanism having a piston which is spring biased to maintain the mounting distance in a ski position and a gas source to bias the piston to a release position when a ski mounted receiver receives the remote signal.

17. The system claim 16 further comprising a track suited to receive either the toe or the heel piece, said track connected to the mechanism.

18. The system of claim 16, wherein the mechanism, the piston, the receiver and the gas source all share a common housing.

19. A ski binding release system comprising:

a toe and a heel piece forming a forward release binding system having a toe release mechanism, a heel release mechanism and a snow brake that is thrust downward upon a release of the forward release binding system, wherein an automatic release of the forward release binding system maintains a constant mounting distance between the toe and the heel piece;

a mechanism having an actuator to enlarge the mounting distance between the toe and the heel piece on demand from a remote signal;

said mechanism having a piston which is gas biased to maintain the mounting distance in a ski position and spring biased to a release position when a ski mounted receiver receives a remote signalby releasing the gas from the mechanism; and wherein the mounting distance is increased by the mechanism in the release position.

20. The system of claim 19 further comprising a track suited to receive either the toe or the heel piece, said track connected to the mechanism, said track being moved into the ski position and the release position by the mechanism.

21. The system of claim 19, wherein the mechanism, the actuator and the gas biased piston all share a common housing.

* * * * *